US005826728A

United States Patent [19]

Sheffer

[11] Patent Number: 5,826,728

[45] Date of Patent: Oct. 27, 1998

[54] CONTAINER AND BLANK FOR MAKING SAME

[75] Inventor: Phil B. Sheffer, Thomasville, Pa.

[73] Assignee: Pack 'N Stack, Inc., Philadelphia, Pa.

[21] Appl. No.: 814,732

[22] Filed: Mar. 7, 1997

[51] Int. Cl.[6] ..... B65D 5/486

[52] U.S. Cl. ..... 206/774; 229/120.11; 229/120.18

[58] Field of Search ..... 206/736, 738, 206/745, 746, 769–772, 774; 229/241, 242, 120.11, 120.18; 220/534, 544

[56] References Cited

U.S. PATENT DOCUMENTS

| | | | |
|---|---|---|---|
| 2,457,291 | 12/1948 | Wenzel . | |
| 3,315,875 | 4/1967 | Praetorius | 229/242 |
| 3,347,356 | 10/1967 | Kossnar . | |
| 4,000,811 | 1/1977 | Hardison et al. | 229/242 |
| 4,053,101 | 10/1977 | Hart, Jr. . | |
| 4,058,206 | 11/1977 | Morse et al. | 229/241 |
| 4,153,158 | 5/1979 | Graser et al. | 206/173 |
| 4,213,559 | 7/1980 | Meyers . | |
| 5,048,690 | 9/1991 | Zimmerman . | |
| 5,197,660 | 3/1993 | Colling | 229/120.11 |
| 5,413,276 | 5/1995 | Sheffer . | |
| 5,505,371 | 4/1996 | O'Neill . | |
| 5,524,815 | 6/1996 | Sheffer | 229/120.18 |

*Primary Examiner*—Paul T. Sewell
*Assistant Examiner*—Luan K. Bui
*Attorney, Agent, or Firm*—Eckert Seamans Cherin & Mellott

[57] ABSTRACT

A shipping and display container is formed from an integral piece of corrugated board, paperboard, or the like. The container has a top which includes two opposing flaps allowing access to the contained space of the container for loading. The two flaps are adhered to each other at their opposing edges when the container is closed and sealed for shipping. The top may be removed from the container by separating the top from the sidewalls at perforation lines extending generally at the outer edges of the top. The front of the container has removable portions which are integrally attached to the top so that a pair of windows is formed when the container is opened by the end user's removal of the top together with the removable portions. Product is accessible through the two windows as well as through the top of the opened container. The container is folded and glued from an integral flat blank, and is erected from a collapsed parallelogram shape by moving together outer transverse edges. Reinforcing panels foldably connected to the side panels create double layer sides for the container. A partition is also integrally formed, preferably in three thicknesses, from panels foldably attached to the blank.

13 Claims, 7 Drawing Sheets

CONTAINER AND BLANK FOR MAKING SAME

BACKGROUND OF THE INVENTION

1. Field of the Invention

The invention relates to containers or cartons for packing, shipping, and display, and in particular, concerns a container or carton which preferably is formed from an integral blank of sheet material, and which has structures optimized for erection, packing, stacking, shipment, display and eventual disposal.

2. Prior Art

Containers or cartons are handled by or associated with a variety of different parties that can be considered users. The "users" generally begin with the container manufacturer, and also include the packer, shipper, retailer, customer and finally the recycler or other waste handler. It is generally advantageous for cartons to be structured to address as many of the needs and objectives of such users as possible; however, making a carton most apt for one phase of its use can have adverse effects on the other phases.

Two-compartment packing and shipping cartons are known. One application for such cartons is in the candy packing industry, where they may be used for packing two complementary products. Multiple-compartment cartons are also known which serve as both a shipping carton and a display carton. One such combination shipping-and-display carton comprises a separate, cap-like top which covers a corresponding bottom portion containing the products to be shipped and displayed. The cap-like top for such carton often is a top panel with four, depending sides, referred to as an "HSC," or half-scored carton.

When such two-piece cartons are being packed, the box-like bottom is filled with the carton contents and the cap-like top needs to be fit and attached to the packed bottom at the appropriate point in the packing process. There is thus a need to track and handle two separate items during the packing operation. Likewise, when the carton manufacturer sends multiple carton blanks to the packer, the manufacturer must ship two, separate inventory items corresponding to the top and bottom of the two-piece cartons.

Two-compartment cartons formed from a single, integral blank of sheet material are also known (see, for example, U.S. Pat. No. 2,457,291; U.S. Pat. No. 3,347,256; and U.S. Pat. No. 5,048,690). It is generally advantageous for one-piece cartons to be relatively uncomplicated to manufacture, erect, pack, and handle. For example, the one-piece cartons disclosed in U.S. Pat. No. 5,413,276 have cover panels which often need to be secured to an adjoining panel by a web of material so as not to interfere with automated equipment when being folded into shippers' blanks. Such interconnections must be broken in order for the blank to be erected, such as during packing, and this often makes the packing operation more difficult, especially if automated equipment is involved.

Furthermore, during the packing operation, it is advantageous for one-piece cartons to be taped or otherwise closed with a minimum number of steps using automated taping or adhesive equipment.

With regard to the retailer and customer, it is advantageous, for example, for the one-piece carton to be opened or otherwise transformed easily from its packed configuration to a configuration in which the contents of the carton are displayed for selection by the customer. It would also be advantageous if, when the carton is opened or transformed for display purposes by the retailer, a minimum amount of waste of material is generated, and that any such waste generated is compact and relatively easily disposed of.

Prior art attempts to address these and other needs of users of containers or cartons have met with mixed results. There is a need for a plural-compartment container for packing, shipping, and displaying the container contents, which container serves the varying objectives of the manufacturer, packer, shipper, retailer, customer, and waste handler efficiently and at a minimum expense, while preferably using a single, integral, flat piece of paperboard or the like.

SUMMARY OF THE INVENTION

It is an object of the invention to provide a shipping and display container which includes a plurality of panels positioned to form a bottom, a top, and sidewalls extending between the top and bottom to define a contained space. The sidewalls extend generally upwardly from the bottom when the container is resting thereon. The top of the container has two flaps, each with one side connected to one of two corresponding opposite sidewalls. Each flap extends from its sidewall and terminates in an edge portion. The flap is outwardly foldable to allow access to the contained space of the container. The edge portions are secured relative to each other when the carton is closed for shipping. The first sidewall has a removable section which is integrally connected to a first one of the flaps, that is, formed from the same piece of sheet material as the first one of the flaps. The other (second) flap is removably connected to its sidewall. In this way, the removable section and the first flap can be manually separated from their corresponding sidewall, and the other (second) flap can be manually removed from its sidewall, thereby separating the top from the two sidewalls to which the flaps were previously attached.

According to an inventive aspect, the two flaps have outer edges which correspond to the outer edges of the top. There are perforations at one of the outer edges, and these perforations allow the flap attached at this outer edge to be separated from the sidewall.

According to another aspect of this invention, one of the flaps is formed from two panels which partially overlie each other to form an overlap. One of the panels has a notch which is located at the overlap at the edge of the container. The upper edge of the container is received in the notch.

As yet another aspect, the container includes a partition which extends between two of the container sidewalls and divides the contained space into two compartments. There are two removable sections, each of which is located so that, when removed, there is access to a corresponding one of the compartments.

A blank for a shipping and display container, according to the invention, has at least one front panel and at least one back panel which correspond, respectively, to the front and back of the container. Side panels extend between the front and back panels, and these side panels correspond to the exterior walls of the container. The front, back, and side panels each have a pair of transverse side edges and are foldably connected to each other at opposing ones of these side edges. The front, back, and side panels also have upper and lower edges. Two top flaps are foldably attached to the upper edges of the front and back panels. The top flaps form the top of the container and have their own side edges. A line of perforations extends between the side edges of each of the top flaps so that the top flaps can be separated manually from the remainder of the blank. One of the lines of perforations extends into the front panel from the corresponding flap and thereby defines a separable portion in the front panel which is integral with the top flap. Bottom flaps are foldably attached to the lower edges of the front, back, and side panels and correspond to the bottom of the carton. The panels and flaps are formed from an integral sheet of material. The blank is easily erected because the panels are folded along a predetermined pair of transverse side edges to position the back panel and one of the side panels on a first layer, and the front panel and the other of the side panels on a second layer. In this way, the blank is substantially flat before it is deployed and, upon movement of the predetermined pair of transverse edges toward each other, the blank is deployed from its collapsed state into a three-dimensional state forming the container.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
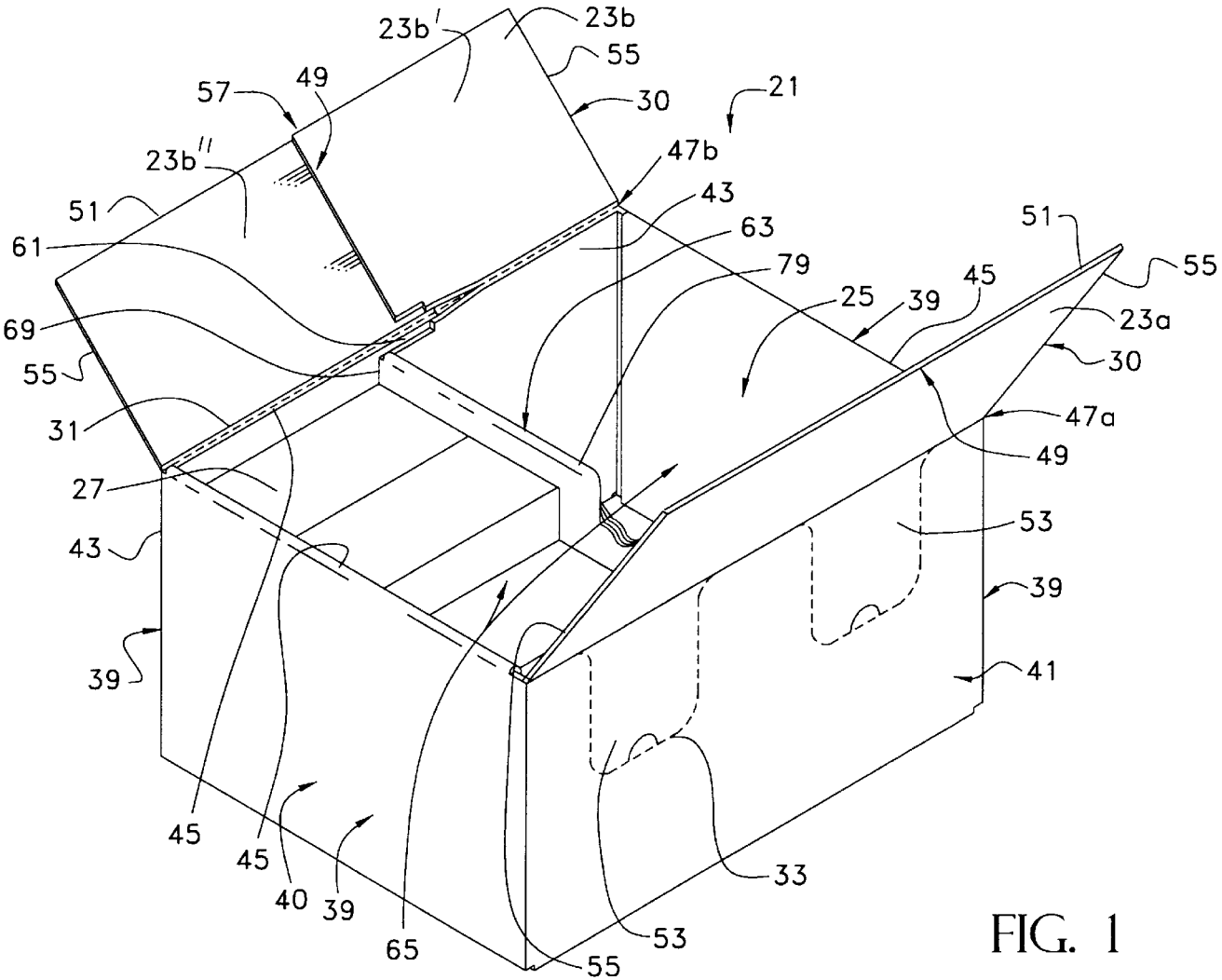
FIG. 1 is a perspective view of a container according to the invention, ready to be packed with its contents.

Referring generally to FIGS. 1–6, a carton or container 21 as shown is optimized for manufacture, erection, stacking, shipping, display of its contents, and finally collapse and recycling. Container 21 has a pair of top flaps 23*a* and 23*b* extending from two of the container's walls 39. The flaps 23*a*, 23*b* are foldable away from each other (FIG. 1) so as to access contained space 25 defined by the walls 39 of container 21, and toward one another when closing the container. Access to contained space 25 by pivoting open flaps 23*a*, 23*b* is desirable during packing of container 21 with its contents 27 after erecting container 21 from a collapsed state.

As best seen in FIG. 2, flaps 23*a* and 23*b* are securable relative to each other, such as by applying a strip of tape 29 overlapping the flap edges. This closes the container, which is generally desired after container 21 has been packed, to seal the container in preparation for shipment. When the top flaps 23*a* and 23*b* are sealed in this manner, they define a top 30 for container 21.

Perforation lines 31 and 33 (FIG. 1) are located between the top flaps 23*a* and 23*b* and their respective sidewalls 39, and extend between the opposite sides of the flaps. The perforation lines allow the flaps to be manually separated from the remainder of container 21 as shown in FIG. 2, which in turn allows top 30 to be lifted off the container, thereby exposing the contents 27 for sale or the like. The contents 27 can thus be displayed after shipment of container 21 without unloading the container 21. Top 30 is readily removable, and generates minimal waste material, which material is advantageously substantially flat.

Figure 4:
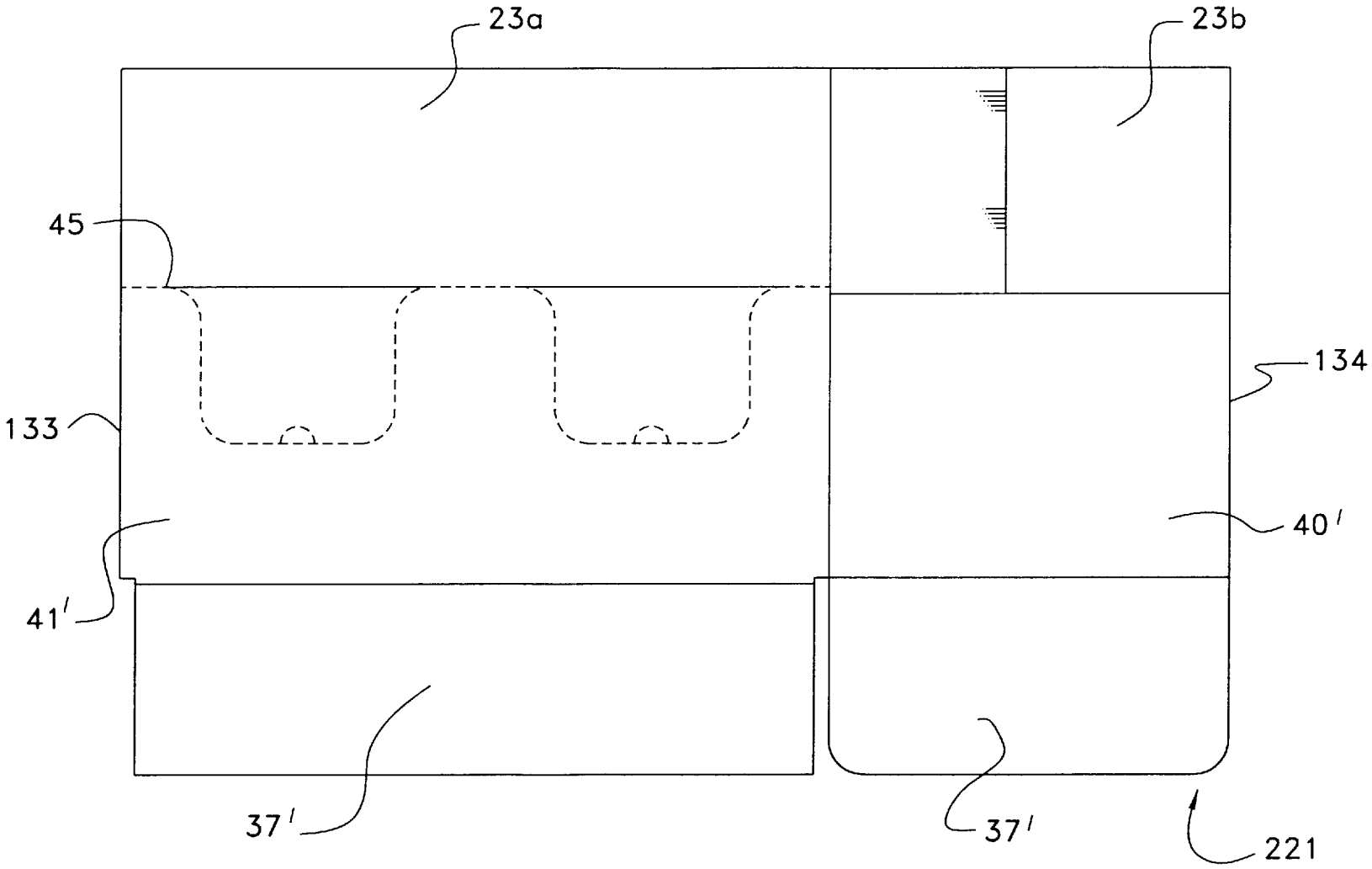
FIG. 4 is a top plan view of another blank for the shipping and display container of FIGS. 1 and 2 formed from the integral sheet of material shown in FIG. 3 by folding and adhesive operations.
Figure 5:
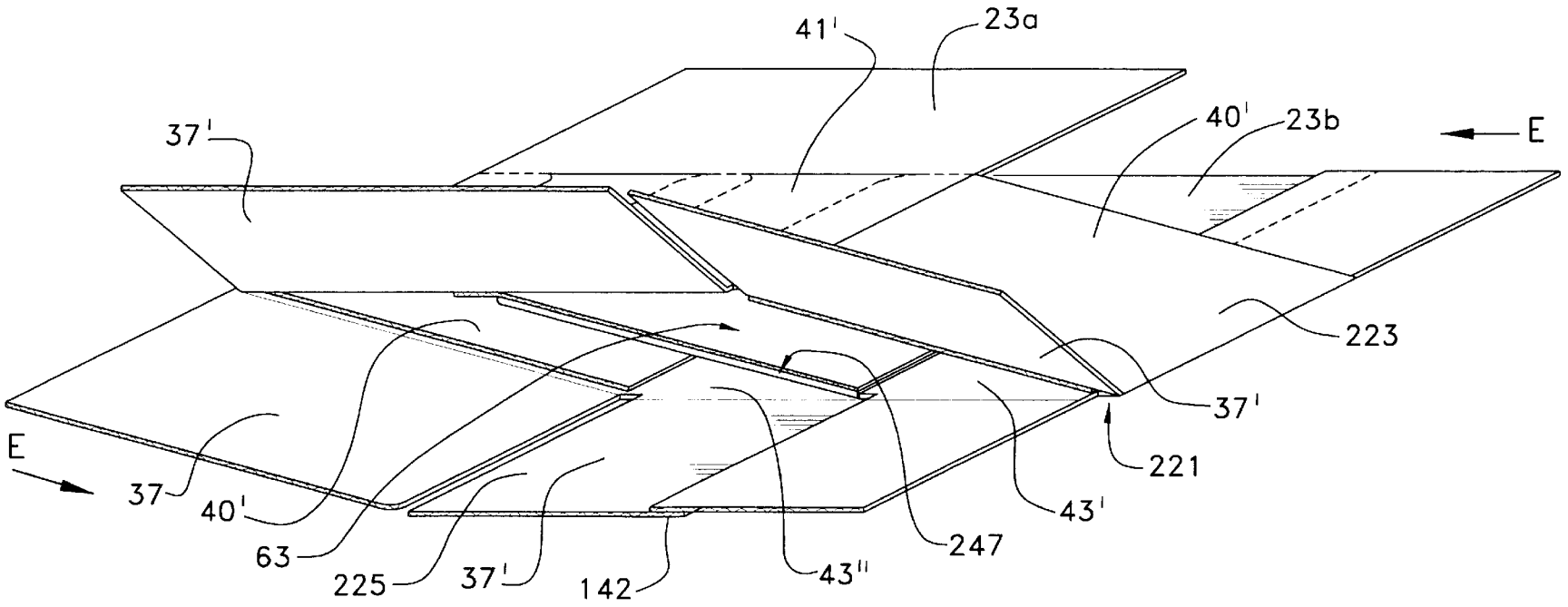
FIG. 5 is a perspective view of the blank of FIG. 4 in a partially erected state.

Container 21 is readily erected or deployed from a one-piece blank 121 shown in FIGS. 4 and 5. Blank 121 is preferably formed from a single, integral sheet of corrugated board, card stock, or the like. The blank is cut from a sheet and passed through a fold-and-glue machine that affixes certain edges as described below for storage or shipment as a knocked-down collapsed container. In general terms, blank 121 is transformable from its substantially collapsed state shown in FIGS. 4 and 5 to its three-dimensional, deployed or erected state of FIG. 1 by moving outer transverse edges 123 toward each other for opening the inside dimensions in the manner of a parallelogram, while folding bottom flaps 35 inwardly.

Container 21 is sealable for shipping with a minimal number of taping or adhesive operations. As seen in FIG. 2, bottom 37 and top 30 are sealed with strips of tape 29 extending in substantially the same direction and therefore applicable to container 21 by automated means without reorienting container 21.

Referring now more particularly to FIG. 1, container 21 includes a plurality of panels which are disposed to form bottom 37, top 30, and four walls 39 extending between top 30 and bottom 37. A six-sided rectilinear box shape is thus formed, and when container 21 is resting on bottom 37, walls 39 extend generally upward therefrom to top 30. Accordingly, walls 39 terminate in an upper container edge 45. In this embodiment, one of the walls 39 comprises a front 41, while the wall 39 opposite from 41 comprises back 43. The other two, opposite walls 39 extending between front 41 and back 42 comprise sides 40. The terms "top," "bottom," "front," "back" and "side, " which imply a particular orientation of the container 21, are used in this disclosure to distinguish among the walls, and are not intended to limit the invention to a container that can be used only in a particular orientation.

Top 30 has two, opposite outer edges 47*a* and 47*b*, which in this embodiment extend along upper container edge 45 at the front 41 and the back 43 of container 21. Top 30 is preferably formed of only two top flaps 23*a* and *b*, although, alternately, additional top flaps may be provided. Top flap 23*a* extends from corresponding outer edge 47*a* at front 41, and top flap 23*b* extends from corresponding outer edge 47*b* at back 43. The top flaps 23*a* and 23*b* terminate in respective edge portions 49 which, in turn, terminate in flap edges 51. Flap 23*a* and 23*b* are sized so that when they are closed over the contained space 25 (FIG. 2*a*), flap edges 51 either overlap each other or oppose each other sufficiently closely that strip of tape 29 can be applied to the exterior of top 20 between and along the length of the opposite flap edges 51, and thereby adhere the flaps 23*a* and 23*b* to one another.

Top flaps 23*a* and 23*b* are removably connected to their respective walls, that is to front 41 or back 43. In the embodiment shown, the removable connection of flap 23*a* is accomplished by means of a line of perforations 33 that divert into front 41, and the removable connection of flap 23*b* is accomplished by means of a line of perforations 31 wholly in the plane of the upper edge. Variations are possible. Perforations 31, 33 extend between opposite side edges 55 of each of top flaps 23*a* and 23*b*, respectively. Line of perforations 33 has portions which extend partly along outer edge 47*a*, while other portions of perforation line 33 extend from outer edge 47*a* onto front 41 to define two, removable portions 53. Removable portions 53 are integrally attached to flap 23*a* at outer edge 47*a*. Perforation line 31 extends substantially along outer edge 47*b* although alternate locations on flap 23*b* are equally suitable for certain applications.

Figure 2A:
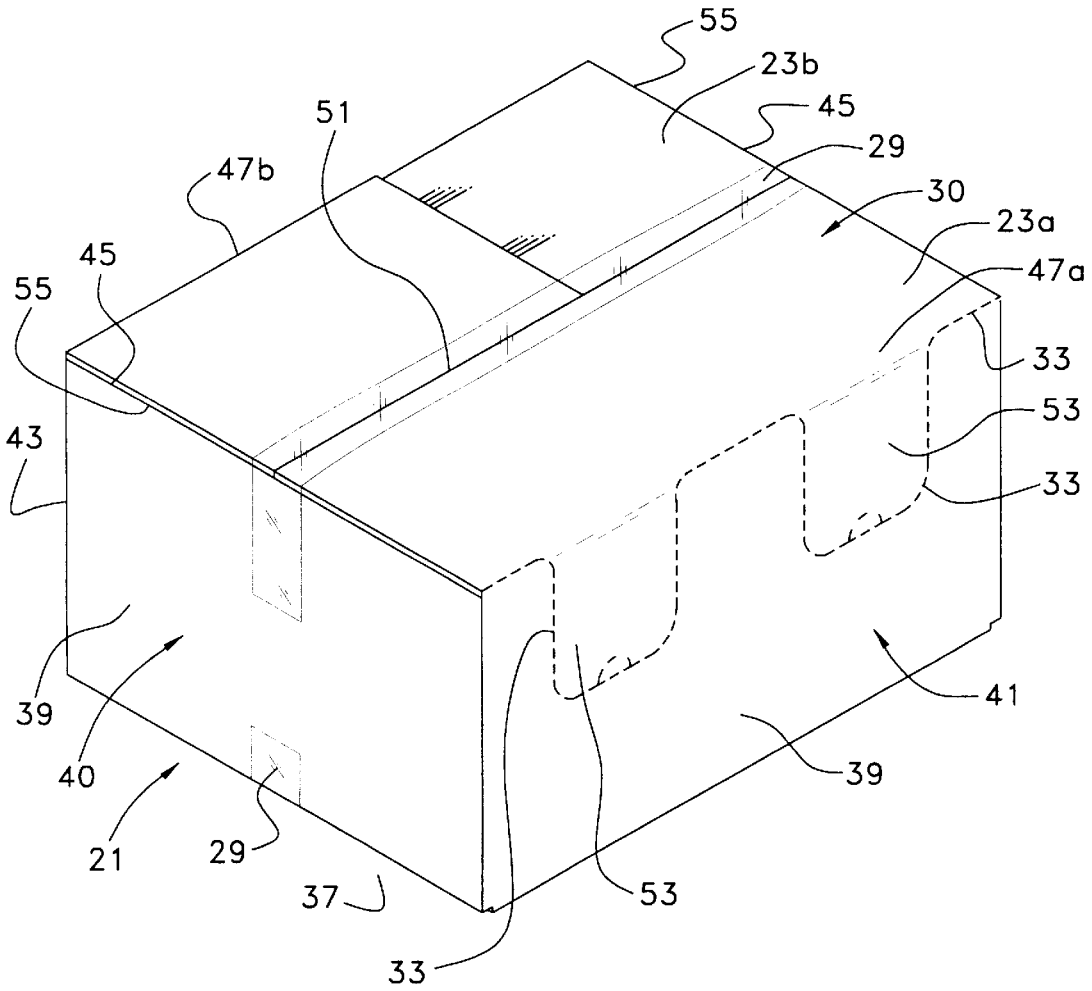
FIGS. 2*a* and 2*b* are perspective views of the container of FIG. 1 after it has been fully packed shown closed and sealed in FIG. 2*a* and with the top removed therefrom in FIG. 2*b;*
Figure 2B:
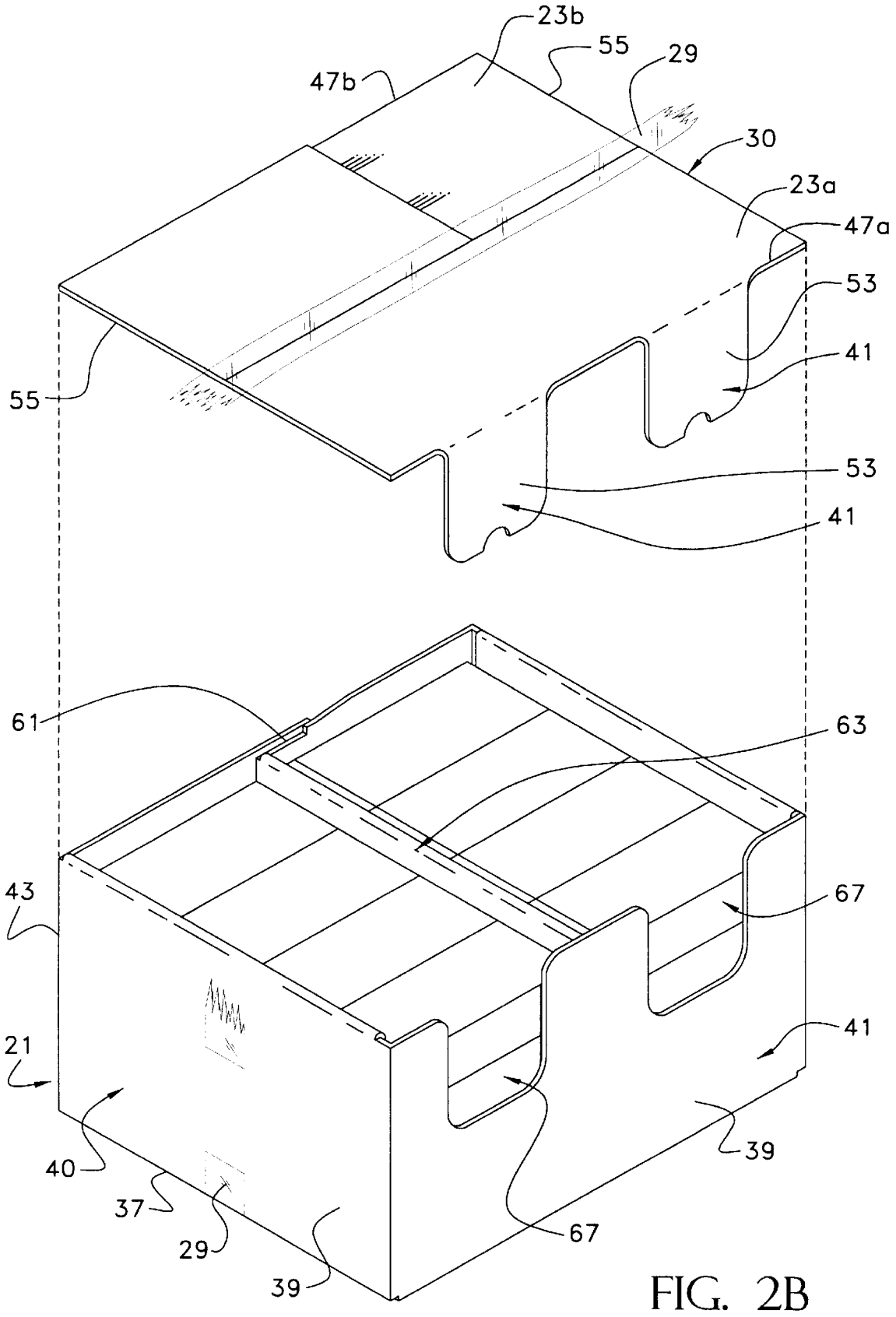

Container 21 is opened as shown in FIG. 2*b* from the closed and sealed state shown in FIG. 2*a* by separating flaps 23*a* and 23*b* from their respective walls along the perforation lines 33, 31. Strip of tape 29 is removed from attachment to sides 40 of container 21, or cut or otherwise broken to release connection of the top via tape 29. Top 30 separates from container 21 at its outer edges 47*a* and 47*b*. If strip of tape 29 is left adhered between flaps 23*a* and 23*b*, then top 30 is removable from container 21 as a single, substantially flat piece, which includes the two removable portions 53 integrally and foldably attached to top 30 at outer edge 47*a*.

Top flap 23*b* is formed from two panels 23*b*' and 23*b*" which partially overlie each other at their opposing edges to form an overlap 57. The overlapped edge of panel 23*b*' is interior to that of 23*b*", meaning that it is located on the interior surface facing and partly defining contained space 25 when container 21 is closed as shown in FIG. 2*a*. This interior panel 23*b*' has a notch 59 at overlap 57, proximate to or at outer edge 47*b*. When flap 23*b* is sealed against upper container edge 45 as shown in FIG. 2*a*, the upper container edge 45 is received in the notch 59. In this way, when flap 23*b* is sealed to upper edge 45, notch 59 reduces or eliminates outwardly directed force which would otherwise bear against the top by interior panel 23*b*' at overlap 57 near outer edge 47. This structure minimizes or prevents inadvertent separation or "gapping" of 23*b* at or near overlap 57 when the container is in its closed and sealed state shown in FIG. 2*a*. Back 43 of container is similarly formed with a notch 61 proximate to upper container edge 45 and aligned with overlap 57. Notch 61 further contributes to minimizing undesirable upwardly or outwardly directed separation forces exerted on perforation 31 at or near overlap 57 when top flap 23*b* is closed.

Referring again to FIG. 1, as well as to FIG. 2*b*, a partition 63 extends between front 41 and back 43, dividing contained space 25 into two compartments 65. Partition 63 has substantially the same vertical extension or height as walls 39 and contributes to the vertical compression strength of container 21. By extending between opposite front 41 and back 43, partition 63 also strengthens the container against inward compression of front 41 and back 43 and against lateral shear or lateral displacement of walls 39.

Removable portions 53 are disposed on front 41 at either side of partition 63. Each compartment 65 has one of the removable portions 53 on one of its walls. When the top 30 (including integral removable portions 53) is removed as shown in FIG. 2*b*, a pair of open windows 67 are defined in front 41 through which access can be had to contents 27 in each of the compartments 65, at least partly through the front of the carton. These windows also allow the contents of the carton to be viewed more easily, especially if the carton is disposed at approximately the viewing height of the customer.

Figure 3:
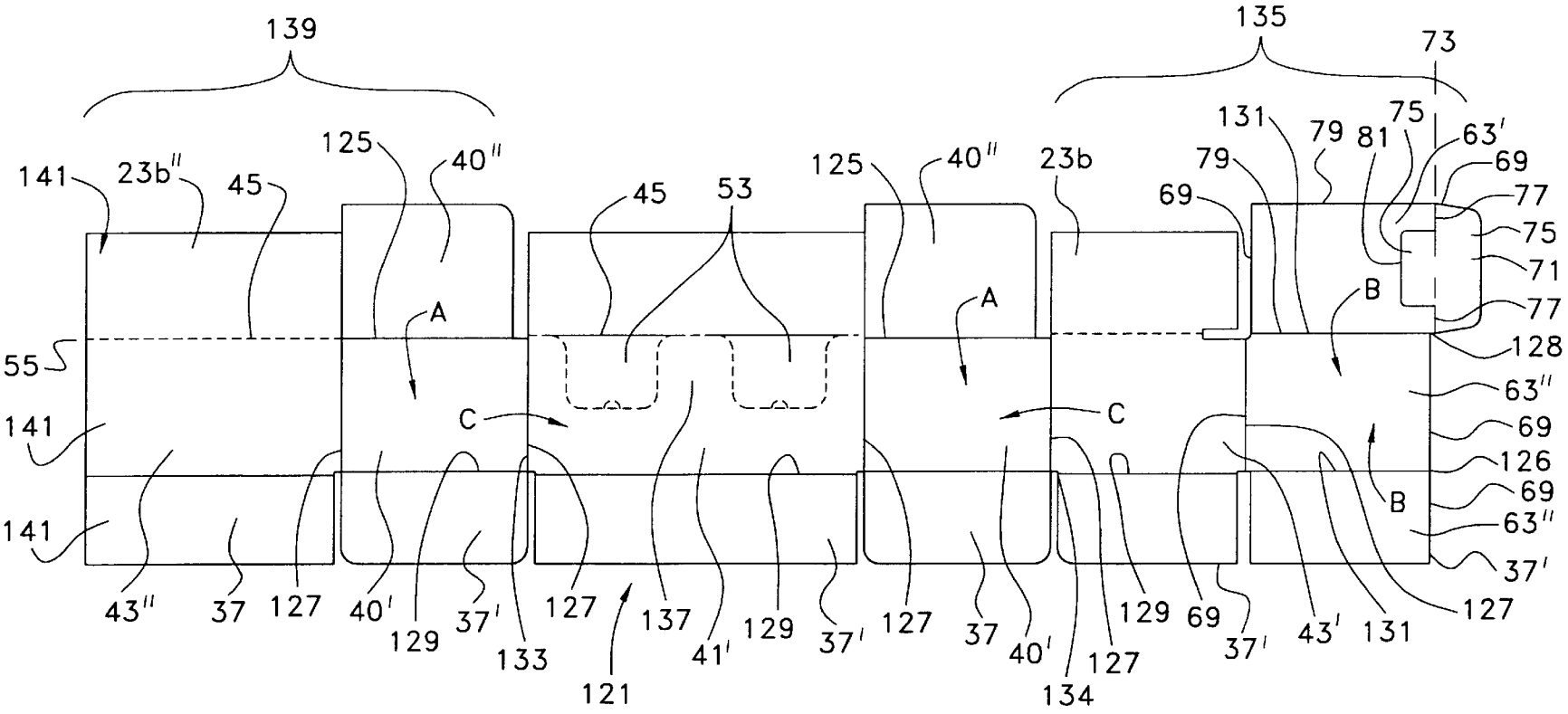
FIG. 3 is a top plan view of a blank for the container of FIGS. 1 and 2 in the form of an integral sheet of material according to the present invention.

FIGS. 3–5 show blanks 121, 221 for making container 21, in different states. Blank 121 (FIG. 3) is preferably formed by die-cutting a single piece of sheet material, such as cardboard. The integrally connected panels of blank 121, shown in FIG. 3, undergo a series of folding and adhesive steps to transform blank 121 into blank 221 as shown in FIGS. 4 and 5. The blank for container 21 is thus shown in FIG. 3 before any folding of its constituent panels relative to each, whereas the blank for the container 21 appears in FIGS. 4 and 5 after undergoing folding and adhesive operations discussed below, but which nonetheless allow the blank 221 to remain in a substantially flat knocked down condition for shipping from the container manufacturer to the packer.

A blank in the form of blank 221 is sometimes referred to as a "shipper's blank", because even though container 21 is still in a substantially flat, collapsed state, only a few folding and adhesive steps are needed to erect the container. While it is often desirable for a container manufacturer to perform as many of the folding and adhesive steps as practicable in creating a shipper's blank, the particular steps done by the manufacturer, packer, or shipper can be shared as necessary to suit the particular application. Accordingly, it is to be understood that the term "blank," as used in this specification, encompasses substantially flat structures which are deployable to create container 21 and which are at any of the stages on the continuum between the unfolded and un-adhered blank 121 shown in FIG. 3 and the folded and adhered blank 221 of FIGS. 4 and 5.

Blank 121 is shown in FIG. 3 in its unfolded, un-adhered state after having been diecut from a single sheet of material and blank 121 is shown in FIGS. 4 and 5 after the plurality of panels of FIG. 3 have been folded and adhered relative to each other as described below. As seen in FIGS. 3–5, blank 121 includes a single front panel 41' corresponding to front 41 of container 21. Blank 121 also includes two panels 43', 43 " which are adhered together as discussed below to correspond to back 43 of container 21. Side panels 40' extend and interconnect front panel 41' and the two back panels 43', 43". Side panels 40' correspond to the sides 40 of container 21. These panels 40', 41', 43' and 43" are foldably interconnected at opposing, transverse or vertically-oriented side edges 127. Upper edge 45 discussed previously with reference to FIGS. 1 and 2, extends between side edges 127 of the panels 40', 41', 43', and 43".

To facilitate folding where required, the fold lines can be compressed, scored or otherwise weakened as a part of the die cutting process. In addition, perforation lines can be made in the form of short cuts separated by spaces in known manner. As described above with reference to FIGS. 1 and 2, top flap 23*b* comprises two panels 23*b*' and 23*b*" which are removably and foldably attached to back panels 43', 43", respectively. Perforation line 31 extends between side edges 55 of top panels 23*b*' and 23*b*" substantially at or proximate to upper edge 45 of back panels 43', 43".

A panel 23*a*' corresponding to top flap 23*a* is removably connected to front panel 41' at upper edge 55. Perforation line 33, as described with reference to FIGS. 1 and 2, extends at the fold line between front panel 41' and top flap panel 23*a*' and defines removable portions 53 in front panel 41'.

Panels 40', 41', 43' and 43" have lower edges 129 to which a plurality of bottom panels 37' are foldably connected to form bottom 37 of container 21.

A side reinforcing panel 40" is foldably connected to each of the side panels 40' at upper edges 45 of side panels 40'.

Figure 6:
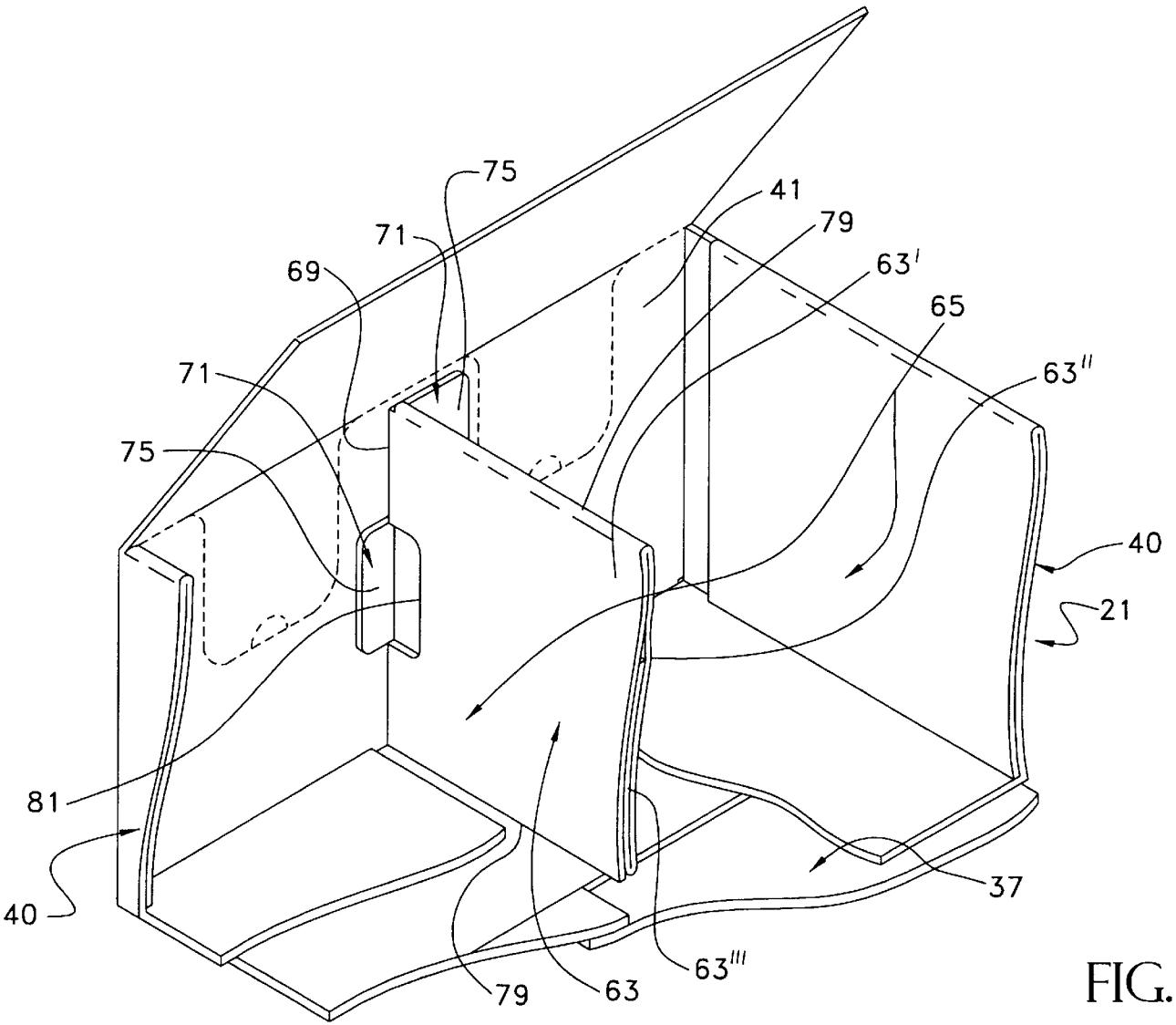
FIG. 6 is a partial perspective view of the container of FIGS. 1 and 2.

Referring to FIGS. 1, 3, and 6, partition 63 comprises three panels 63', 63", 63'", each of which terminate in opposite transverse edges 69 located at front 41 and back 43. Partition 63 has a partition flap 71 formed integrally with panel 63' and located at the transverse edge 69 adjacent to the front 41. Partition flap 71 is foldable along an axis 73 which is substantially parallel to and, in this embodiment, coincident with one of transverse edges 69.

When folded, partition flap 71 has two tabs 75 extending substantially in opposite directions and generally outwardly from a plane coincident with panel 63'. The two tabs 75 are adhered to the inner surface of front 41 as shown in FIG. 6 and thereby reenforce front 41 over a surface area corresponding to the combined surface areas of the two tabs 75. As best seen in FIG. 3, partition flap 71 is formed by a pair of fold lines 77, each extending inwardly from a corresponding longitudinal edge 79 of panel 63'. Fold lines 77 each terminate in an inwardly extending cut 81. In this embodiment, cut 81 is "U-shaped ".

Panel 63" is foldably attached to the outer, transverse edge 127 of back panel 43'. Panel 63' and 63'" are foldably attached to upper and lower longitudinal edges 131 of partition panel 63".

The panels of blank 121 described above are folded and adhered so as to assume the form shown in FIGS. 4 and 5. this is preferably accomplished by passing the flat blank through a fold-and-glue apparatus that applies adhesive and folds the blank where needed. Reenforcing side panels 40" are folded along fold line 125 in the direction indicated by the arrow A until they overlie corresponding side panels 40'. Each side 40 of container 21 is thus a two-layer structure. Adhesive is provided at a suitable point in time to secure panels 40' and 40" in relation to each other.

Partition 63 is a triple-layer structure formed by folding panel 63'" along fold line 126 to overlie panel 63", providing substantial vertical compression resistance. Panel 63' is folded to overlie panels 63", 63'" along fold line 128. When the partition is folded as shown in FIG. 3, panel 63' becomes the top-most of three-layers of partition 63, and partition flap 71 is co-planar with such top layer. Again suitable adhesive is applied to secure the panel 63', 63 ", 63'" in relation to each other at a suitable point during creation of blank in the form shown in FIGS. 4 and 5.

Transverse, vertically oriented side edges 127 include a predetermined pair of edges 133, 134 about which the panels are further folded to transform the blank 121 shown in FIG. 3 into the blank 221 shown in FIGS. 4 and 5. In describing these folding operations, panels between predetermined transverse edges 133, 134 will be referred to as lying "to the inside" of the transverse edges 133, 134, whereas the other panels will be referred to as "to the outside" of the corresponding predetermined edge 133 or 134, as shown in FIG. 3.

The panels to the outside of predetermined edge 134 comprise panels 43', **23*b*' , 63', 63" 63'", and two of the panels 37'. These panels comprise a panel unit indicated by 135. The panel unit 135 is folded in the direction of arrow 'C' along transverse edge 134. Suitable adhesive is supplied to the appropriate surface flap 71 or to medial portion 137 of front panel 41', so that partition flap 71 is adhered to medial portion 137 after it has been folded as part of panel unit 135**.

The panels to the outside of transverse side edge 133 comprise one of the side panels 40', one of the side panels 40", panels 43", **23*b*' , and two of the panels 37'. These panels comprise panel unit 139 and are folded along transverse edge 133 in the direction indicated by arrow C. Panels 23*b*", 43" and the outer one of panel 37' are 139 have sufficient length so that their outer edge portions 141 as shown in FIG. 3 overlap corresponding edge portions of, respectively, panel 23*b*', panel 43', and the panel 37' attached to panel 43', thereby forming an overlap 142 best seen in FIG. 5. Suitable adhesive may be applied so that overlying panels are adhered to each other at overlap 142**.

After performing the above described folding and adhesive operations, blank 121 is transformed substantially to blank 221 shown in FIGS. 4 and 5. The predetermined pair of transverse edges 133, 134 are located at opposites sides of blank 221 when it has been folded and adhered as described above. When positioned as shown in FIGS. 4 and 5, the panels of blank 221 comprise multiple layers with surfaces which are opposing and adjacent each other, thereby giving the blank 221 a substantially flat knocked down structure that can be shipped compactly and is readily erected prior to packing.

Layer 223 shown in FIG. 4 includes front panel 41', one of the side panels 40', the bottom panels 37' which are attached to the lower edge of the foregoing panels 40', 41', and top flap **23*a*, foldably attached to top panel 41' at its upper edge 45. A second layer 225, best seen in FIG. 5, includes the other of the side panels 40', back panels 43', 43", the bottom panels 37' attached to the lower edges of the aforementioned panels, and top flap 23*b*. Partition 63 (FIG. 5) forms an intermediate layer 247 between the layers 223, 225**.

To erect or deploy blank 221 from its substantially flat, collapsed state shown in FIGS. 4 and 5 to a three dimensional state for packing, shipping, and all subsequent activities, the predetermined transverse edges 133, 134, which define the outer edges of the blank 221 as shown in FIGS. 4 and 5, are pressed toward each other generally in the direction indicated by arrows E. As the container becomes rectilinear, front 41 and back 43 assume positions opposite one another with sides 40 extending perpendicularly therebetween. Bottom flaps 37' are folded in suitable fashion to form bottom 37. Once the various components become positioned as shown in FIG. 1, container 21 is ready to be packed with its contents 27. The container is packed before the top flaps are closed, and can be packed before the bottom flaps are taped or similarly sealed, provided the bottom flaps are closed, permitting the top and bottom flap seams to be sealed at the same time.

In addition to the advantages apparent from the foregoing description, the container 21 has a top which allows ready access for packing the container between a pair of opposing flaps. The top can be removed along perforations by the retailer or other user, by which action the shipping container serves as a display container as well. The top is readily separable and generates a minimum of waste which is substantially flat and thereby easily disposed of.

The blanks 121, 221 according the invention have cost advantages and are also functionally and structurally advantageous for the manufacturer, packer, shipper, retailer and customer. In a single integral piece, the container is compact and substantially flat before and after die cutting and folding/gluing. The blank 121 as shown in FIG. 3 has a substantially constant height across its length and can be diecut from a sheet of material without generating much waste material. As a further advantage, the various panels can be folded and adhered to each other to form a shippers blank which is substantially flat and yet which remains easy to assemble by the packer.

As a further advantage, the top and bottom of the container can be sealed after packing without substantially reorienting the container relative to the automated taping equipment.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed:

1. A shipping and display container comprising a plurality of panels positioned to form a bottom, a top, and walls extending between the top and bottom to define a contained space, the walls extending generally upwardly from the bottom when the container is resting thereon, the walls including first and second, opposite walls;

the top comprising first and second flaps, each of the flaps having one side connected to a respective one of the first and second walls, the flaps extending from the walls and terminating in edge portions, the flaps being outwardly foldable to access the contained space;

means for securing the edge portions relative to each other when the carton is closed for shipping;

the first wall having a removable section integrally connected to the first flap along a first weakened line;

the second flap removably connected to the second wall along a second weakened line;

whereby the top is separated from the first and second walls when the removable section is separated from the first wall and when the second flap is removed from the second wall;

wherein the edge portions terminate in opposing flap edges, the securing means comprising tape adhered to the edge portions and extending between the opposing flap edges;

wherein the plurality of panels is formed from an integral blank of sheet material; and, further comprising a partition comprising at least one of the panels terminating in opposite transverse edges, the container further comprising at least one partition flap defined integrally with said one of the panels and located at one of the transverse edges, the flap being foldable along an axis substantially parallel to said one of the transverse edges, the flap, when folded, having first and second tabs extending in substantially opposite directions and generally outwardly from a plane coincident with the panel.

2. The container of claim 1, wherein the top has first and second outer edges, the first and second flaps extending from the first and second outer edges, respectively, and wherein the second outer edge comprises perforations, the second flap separating from the second wall at the perforations when the top is separated from the second wall.

3. The container of claim 2 further comprising an upper container edge, and wherein the perforations are located at and extend partially along the upper container edge.

4. The container of claim 1 comprising a front and a back, wherein the first wall comprises the front and the second wall comprises the back.

5. The container of claim 1, further comprising a partition extending between the first and second walls and dividing the contained space into two compartments, and further comprising two of the removable sections each located to allow access to a corresponding one of the compartments when removed.

6. A shipping and display container comprising a plurality of panels positioned to form a bottom, a top, and walls extending between the top and bottom to define a contained space, the walls extending generally upwardly from the bottom when the container is resting thereon, the walls including first and second, opposite walls;

the top comprising first and second flaps, each of the flaps having one side connected to a respective one of the first and second walls, the flaps extending from the walls and terminating in edge portions, the flaps being outwardly foldable to access the contained space;

means for securing the edge portions relative to each other when the carton is closed for shipping;

the first wall having a removable section integrally connected to the first flap along a first weakened line;

the second flap removably connected to the second wall along a second weakened line;

whereby the top is separated from the first and second walls when the removable section is separated from the first wall and when the second flap is removed from the second wall;

the top having first and second outer edges, the first and second flaps extending from the first and second outer edges, respectively, and wherein the second outer edge comprises perforations, the second flap separating from the second wall at the perforations when the top is separated from the second wall;

further comprising an upper container edge, and wherein the perforations are located at and extend partially along the upper container edge; and, wherein the second flap is comprised of a first and second one of the panels, the second panel partially overlying the first panel to form an overlap, the second panel having a notch therein located at the overlap at the container edge, the upper container edge being received in the notch.

7. A knocked-down erectable shipping and display container comprising:

a single integral blank of corrugated material;

a plurality of panels integrally formed from the blank and folded in relation to each other to form a bottom, a top, a front, a back, and opposite sides, the front having a pair of windows outlined by perforations;

a partition formed from at least one of the panels and extending between the front and the back, the partition having first and second opposite, transverse edges; and a partition flap defined at the first transverse edge, the partition flap having first and second portions secured to one of the front and the back with the first transverse edge located between the first and second portions;

the panels, the partition and the partition flap being adhesively secured to one another and foldable relative to one another such that the container can be knocked down flat and erected to separate the panels and erect the container;

the top further comprising a removable portion covering the windows and extending from the front at least partially toward the back, the removable portion being substantially flat upon its removal from the container; and, wherein the partition further comprises first and second, opposite longitudinal edges, and wherein the partition flap is defined by a fold line extending inwardly from each of the longitudinal edges and terminating in an inwardly extending cut.

8. A blank for a shipping and display container comprising:

at least one front panel and at least one back panel corresponding, respectively, to the front and back of the container;

side panels extending between the front and back panels, the side panels corresponding to the exterior walls of the container;

the front, back and side panels each having a pair of transverse side edges, the front, back, and side panels foldably connected to each other at opposing side edges;

the front, back and side panels each having upper and lower edges;

first and second top flaps foldably attached to the upper edges of the front and back panels, respectively, the top flaps corresponding to the top of the container and having side edges;

first and second lines of perforations extending between the side edges of the top flaps so that the top flaps are manually separable from the blank, the first line of perforations extending into the front panel from the upper edge thereof to define a separable portion in the front panel which is integral with the first top flap at the upper edge of the front panel;

bottom flaps foldably attached to the front, back, and side panels at the lower edges thereof, the bottom flaps corresponding to the bottom of the carton;

wherein the panels and flaps are formed from an integral sheet of material, the panels being folded along a predetermined pair of transverse side edges to position the back panel and one of the side panels on a first layer, and the front panel and the other of the side panels on a second layer which is at least partially positioned over the first layer, the top and bottom flaps being substantially coplanar with the layers, whereby the blank is substantially flat in its collapsed state;

wherein movement of the predetermined pair of transverse edges toward each other deploys the blank from its from its collapsed state into a three-dimensional state for erecting the containers;

further comprising a reinforcing panel foldably connected to the upper edge of each of the side panels and two back panels, the back panels having overlapping edges adhered to each other, the two back panels corresponding to the back of the container, the back and front panels having medial portions, the overlapping portions of the back panel being located in the medial portion of the back panel, the blank further comprising at least one partition panel with opposite edges, one edge of the partition panel foldably attached to one of the overlapping edges of the back panel, the other edge of the partition panel adhered to the medial portion of the front panel, the partition panel comprising at least two layers folded into abutment with one another.

9. The blank of claim 8, further comprising a partition flap defined in the partition panel at one of the opposite edges thereof, the partition flap having first and second portions secured to one of the front and the back panel with the partition panel located between the first and second portions.

10. A shipping and display container comprising a plurality of panels positioned to form a bottom, a top, and front, back and side walls extending between the top and bottom to define a contained space, the walls extending generally upwardly from the bottom when the container is resting thereon, the walls including first and second, opposite walls;

the top comprising first and second flaps, each of the flaps having one side connected to a respective one of the first and second walls, the flaps extending from the walls and terminating in edge portions, the flaps being outwardly foldable to access the contained space;

means for securing the edge portions relative to each other when the carton is closed for shipping;

the first wall having a removable section integrally connected to the first flap along a first weakened line;

the second flap removably connected to the second wall along a second weakened line; and, a partition comprising at least two layers of the integral blank that are folded against one another and adhesively affixed together, the partition extending between an integral fold at a junction with one of the front and back panels to a folded tab adhesively affixed to the other of said front and back panels.

11. The shipping and display container of claim 10, wherein the partition comprises two tabs integral with and extending from respective ones of the two layers, the tabs being folded apart and adhesively affixed to said other of said front and back panels.

12. The shipping and display container of claim 11, wherein the partition comprises three panels, each of which terminate in opposite transverse edges located adjacent to the front wall and the back wall, respectively.

13. The shipping and display container of claim 12, wherein the side walls each comprise two layers folded against one another along a top edge of the container and adhesively affixed together.

* * * * *